US008723086B2

(12) United States Patent
McMahan

(10) Patent No.: US 8,723,086 B2
(45) Date of Patent: May 13, 2014

(54) HEAT LAMP

(75) Inventor: Robert L. McMahan, Austin, TX (US)

(73) Assignee: Let's Gel, Inc., Austin, TX (US)

( * ) Notice: Subject to any disclaimer, the term of this patent is extended or adjusted under 35 U.S.C. 154(b) by 407 days.

(21) Appl. No.: 13/040,943

(22) Filed: Mar. 4, 2011

(65) Prior Publication Data

US 2012/0145699 A1 Jun. 14, 2012

Related U.S. Application Data

(60) Provisional application No. 61/364,243, filed on Jul. 14, 2010.

(51) Int. Cl.
*H05B 3/06* (2006.01)
*F21V 23/00* (2006.01)

(52) U.S. Cl.
USPC ..... 219/533; 362/294

(58) Field of Classification Search
USPC ..... 219/532, 533, 552, 553; 362/285, 286, 362/287, 294, 295, 296.01, 297, 299
See application file for complete search history.

(56) References Cited

U.S. PATENT DOCUMENTS

| | | | | |
|---|---|---|---|---|
| 1,637,786 | A * | 8/1927 | Rekar | 362/294 |
| 1,684,081 | A * | 9/1928 | Akers | 392/426 |
| 2,076,446 | A * | 4/1937 | Carwardine | 248/585 |
| 5,097,400 | A * | 3/1992 | Cvek | 362/287 |
| 6,217,199 | B1 * | 4/2001 | Lo et al. | 362/414 |
| 6,227,686 | B1 * | 5/2001 | Takahashi et al. | 362/345 |
| 2002/0176257 | A1 * | 11/2002 | Cummings et al. | 362/391 |
| 2006/0232984 | A1 * | 10/2006 | Schuknecht et al. | 362/373 |

* cited by examiner

*Primary Examiner* — Sang Y Paik
(74) *Attorney, Agent, or Firm* — King & Spalding L.L.P.

(57) ABSTRACT

A heating device of a portable nature is disclosed. The heating device of a portable nature includes a heating element, a hinged coupled to the heating element, and an arm coupled to the hinge.

28 Claims, 14 Drawing Sheets

HEAT LAMP

CROSS-REFERENCE TO RELATED APPLICATION

This application claims the benefit of U.S. Provisional Application No. 61/364,243 filed Jul. 14, 2010, entitled "Heat Lamp," which is incorporated herein in its entirety.

TECHNICAL FIELD

The present disclosure relates to food warming systems and more particularly, to an improved, heat lamp system suitable for home-use.

BACKGROUND

When serving certain foods in a home environment, it is desirable to maintain an appropriate temperature of the food to maintain the palatability of the food and to prevent the development of unsafe biological conditions. Specifically, if certain foods are maintained at temperatures between about 40° F. and about 140° F. for several hours, consumption of that food may present a high risk of food borne illness. In certain situations, prepared foods will be set out for a number of hours in order to stage a large or complex meal or allow people to eat when they are ready.

A number of solutions exist for home use, but each has disadvantages. Some of these solutions are electric warming plates, electric warming drawers, and hot water baths heated by self-contained alcohol burners. In commercial environments, heat lamps are frequently used for this purpose, but commercial heat lamps are generally incompatible with a residential environment because of size, weight, lack of adjustability, non-portability and other factors.

SUMMARY

The incompatibility of heat lamp systems with certain residential environments is solved by the systems and methods disclosed here. Further, the presently disclosed system may serve additional needs, such as providing a safe and rapid system for dehydrating foods. Additional and further benefits may result by employing the presently disclosed systems.

Certain embodiments of the present disclosure provide a heating device of a portable nature. According to one aspect of the invention, there is provided a heating device of a portable nature comprising: a heating element; a hinge coupled to the heating element; and an arm coupled to the hinge.

According to still another aspect of the invention, there is provided a heating device of a portable nature comprising: an emitter of electromagnetic energy; a reflective shield at least partially surrounding the emitter; an external shade at least partially surrounding the reflective shield, the external shade having an air vent; and an air space between the reflective shield and the external shade, whereby convective air is allowed to flow around the heating device, through the air space, and through the air vent.

Another aspect of the invention provides a heating device of a portable nature comprising: a base; a lamp assembly including: an emitter of electromagnetic energy aimed towards a target, a reflective shield at least partially surrounding the emitter and reflecting at least a portion of the electromagnetic energy towards the target, an external shade made from a first thermally insulating material, and a chimney thermally insulated relative to the reflective shield and coupled to at least one of the emitter, the reflective shield and the external shade; and a support arm mechanically connected to the base and the lamp assembly, wherein the support arm movably supports the lamp assembly.

Still further aspects of the invention provide a heating device of a portable nature comprising: a base; a lamp assembly comprising: a means for generating infrared radiation, a means for reflecting infrared radiation toward an intended target, a means for safely channeling high temperature convective air flows through the lamp assembly, and a means for externally shading and insulating the lamp; and a support arm mechanically connected to the base and the lamp assembly, wherein the support arm moveably supports the lamp.

While the term "infrared" is used to describe the energy emitted from the heating devices of the present invention, it should be understood that different embodiments of the invention will emit a much broader electromagnetic spectrum than infrared. In particular, far-infrared, mid-infrared and near-infrared may be used. Further, while emitters of the present invention may primarily emit infrared energy, other wavelengths may also be emitted simultaneously, such as for example, ultraviolet light, visible radiation (light), terahertz radiation, and microwaves. While the term "infrared" is used to describe the energy emitted, it should be understood that this term is intended to broadly include any of the noted wavelengths as well as any combination of the noted wavelengths.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

A more complete and thorough understanding of the present disclosure and advantages thereof may be acquired by referring to the following description taken in conjunction with the accompanying drawings, in which like reference numbers indicate like features. Preferred embodiments and their advantages over the prior art are best understood by reference to FIGS. 1-10 below.

Figure 1:
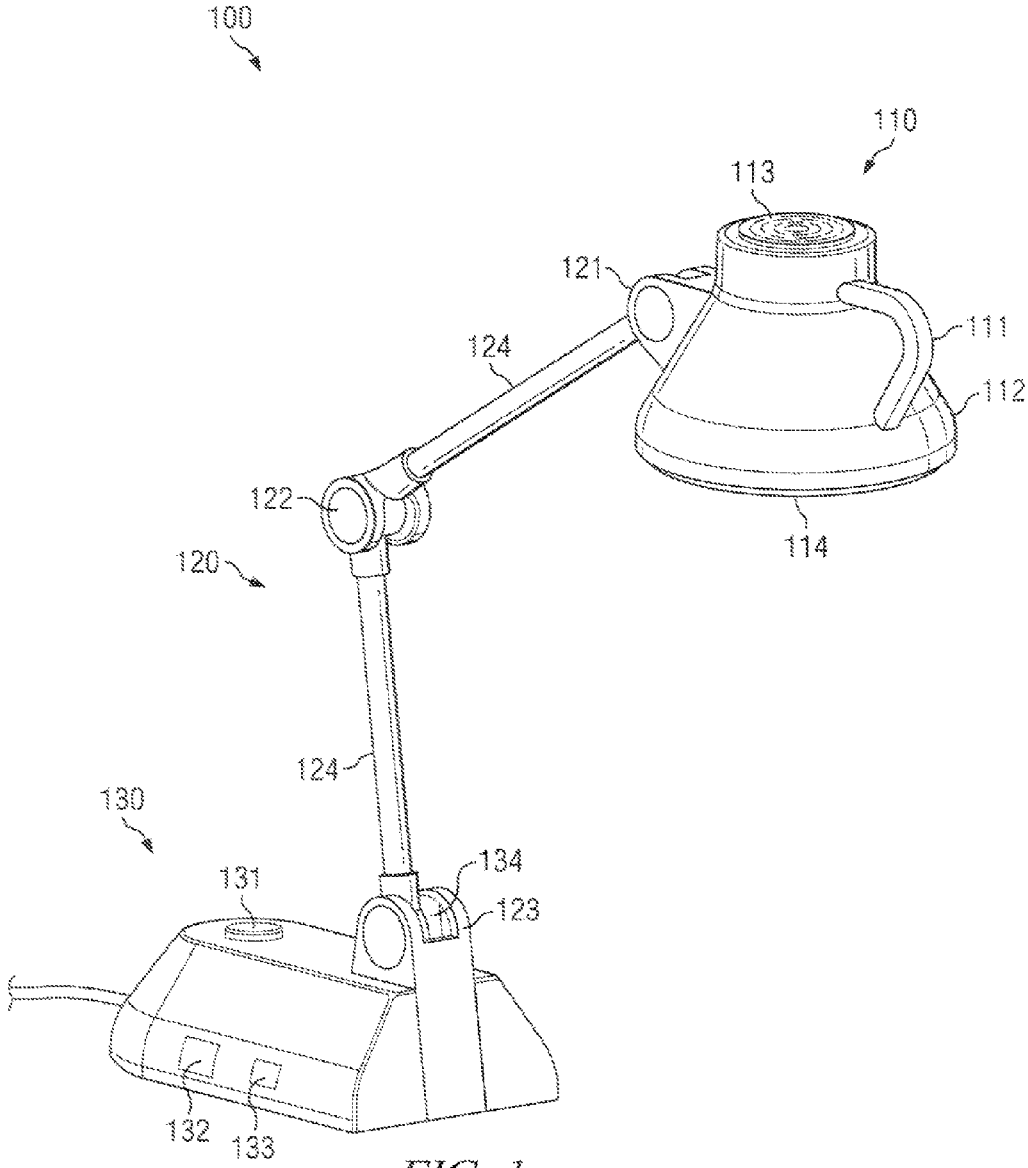
FIG. 1 illustrates a heat lamp according to certain embodiments of the present invention.

FIG. 1 illustrates a heat lamp according to certain embodiments of the present invention. Heat lamp 100 includes lamp 110, support arm 120, and base 130. Heat lamp 100 produces infrared energy in a generally downward direction to warm items below the lamp. One practical application is to maintain a safe temperature of prepared food items to prevent dangerous growth of bacteria in that food. Lamp 110 generates the infrared energy in a generally downward direction while maintaining a safe exterior temperature to prevent burns to a person (during adjustment or by accidental contact) coming into contact with the lamp. Support arm 120 holds lamp 110 at a proper height (e.g., approximately 15 inches) above the countertop or items to be warmed. Support arm 120 may allow for an adjustable height. Base 130 provides stability for heat lamp 100 by providing a foothold for support arm 120. Base 130 may provide this stability through the use of a suitably large weight or through the use of stabilizing structures.

Lamp 110, or head assembly, further includes handle 111, outer shade 112, chimney 113, and grille 114. Handle 111 may be a looped structure suitable for gripping to reposition lamp 110 or to redirect the energy produced by lamp 110. For example, two heat lamps 100 may be used together to heat a large turkey or roast wherein each heat lamp 100 is positioned above and to each side of the item. Handle 111 may be used to angle each lamp 110 towards the item. Handle 111 may be made from a thermally non-conductive material to prevent transfer of heat from the hot portions of lamp 110 to handle 111. In some embodiments, handle 111 is mounted directly to outer shade 112, and is therefore not subjected to significant temperatures.

Outer shade 112 provides a safe, low-temperature external surface for lamp 110 in order to prevent burns or damage that would result from a person or non-heat safe material coming into contact with the high temperature elements of lamp 110. Outer shade 112 may also provide a level of impact resistance to prevent damage to the internal components of lamp 110 should heat lamp 100 tip over or fall during handling. Outer shade 112 may be made from a suitable non-conductive and sturdy material with a high melting point and sufficient rigidity to hold together the components of lamp 110. In certain embodiments, outer shade 112 may incorporate a high-temperature plastic (e.g., polyphenylene sulfide). In certain embodiments, outer shade 112 incorporate metallic material, e.g., cold rolled steel, especially where a low output or highly efficient infrared emitter is utilized. In some embodiments outer shade 112 may be lined with a thermally insulating material.

Figure 2:
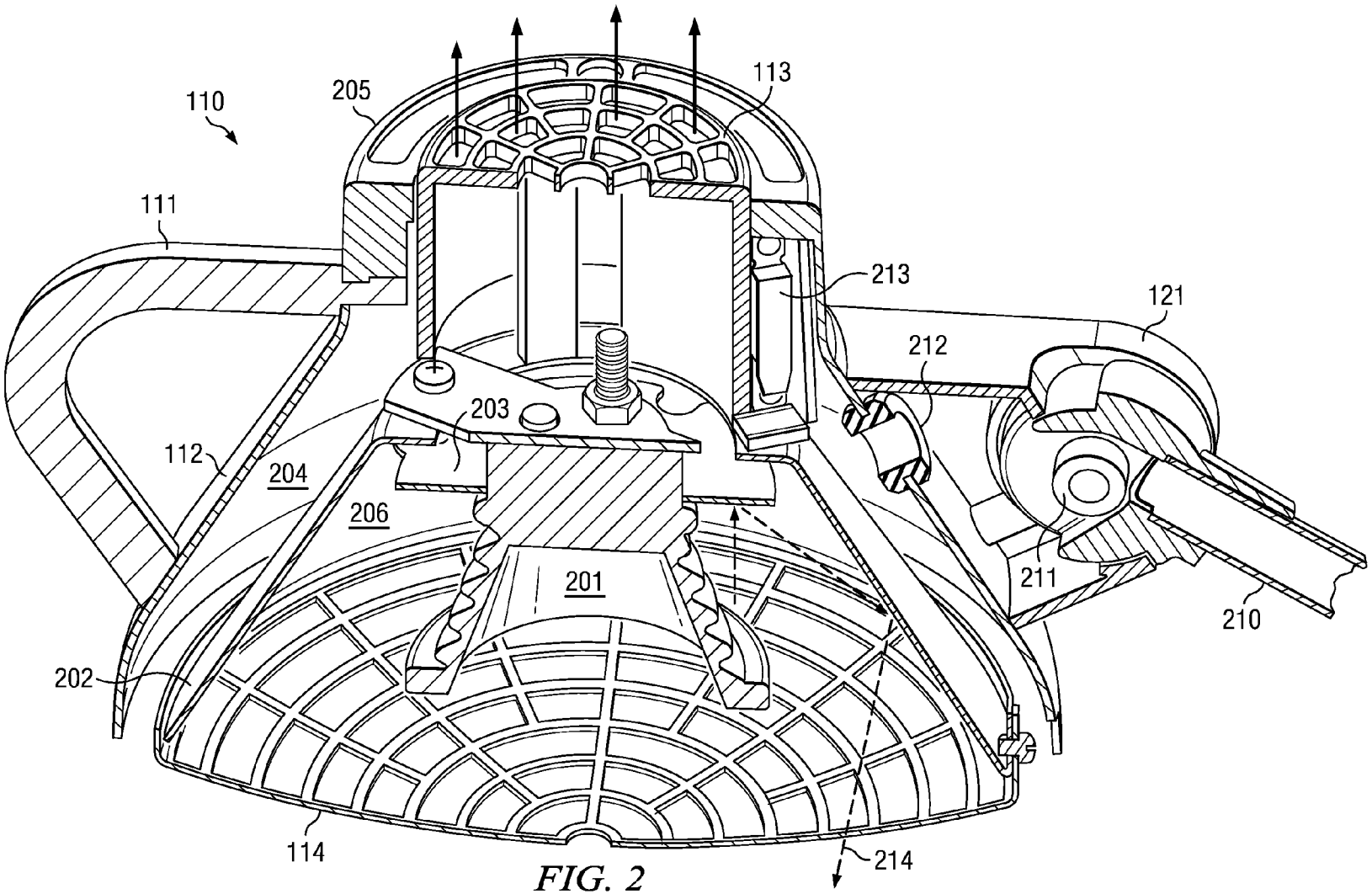
FIGS. 2 and 2A illustrate a cross-sectional views of a portion of a heat lamp, according to certain embodiments of the present invention.

Chimney 113 forms a pathway for heated air to escape, thus allowing convective airflow to cool the internal structures of lamp 110. Chimney 113 may also provide structural support for internal components (as illustrated in FIG. 2 and described below). Chimney 113 may be made from a suitable non-conductive and sturdy material (e.g., polyphenylene sulfide). In some embodiments, chimney 113 may be made from a conductive material, e.g., steel, with additional materials supplied to insulate outer shade 112 and to prevent direct contact from the outside by a person or flammable material. Chimney 113 may include an external grille to prevent intrusion of objects into the high temperature environment within lamp 110 while still allowing convective airflow through the chimney. Materials that are specially formulated to remain stable at higher temperatures may be used. For example, polyphenylene sulfide (PPS), known under the trade name Ryton™ may be used.

Grille 114 maintains a physical separation of internal, high-temperature components of lamp 110 and external elements like hands, surfaces, and food items. Grille 114 may provide protection of fragile internal components from impact with hard objects and from contact with moist foods, which could cause rapid cooling of the internal heating element. Grille 114 may be a wire mesh and may extend past the edge of outer shade 112. Grille 114 may be constructed from a thin wire or reflective wire to reduce wasteful absorption or scattering of infrared energy produced by lamp 110. Grille 114 may be made from a clear material similar to the lens in a halogen light fixture. Alternatively, for embodiments of the invention that use a bulb as the heating element, a grill may or may not be omitted.

Support arm 120 further includes upper lamp pivot 121, elbow 122, lower lamp pivot 123, and arm members 124. Support arm 120 provides separation between lamp 110 and base 130. This separation may be fixed, binary (e.g., either stored or deployed), or variable. Support arm 120 may be interchangeable to allow for different separations. Support arm 120 may be detachable for shipment or storage. More than one support arm may be provided with base 130, each supporting the same or different lamp 110.

Figure 3A:
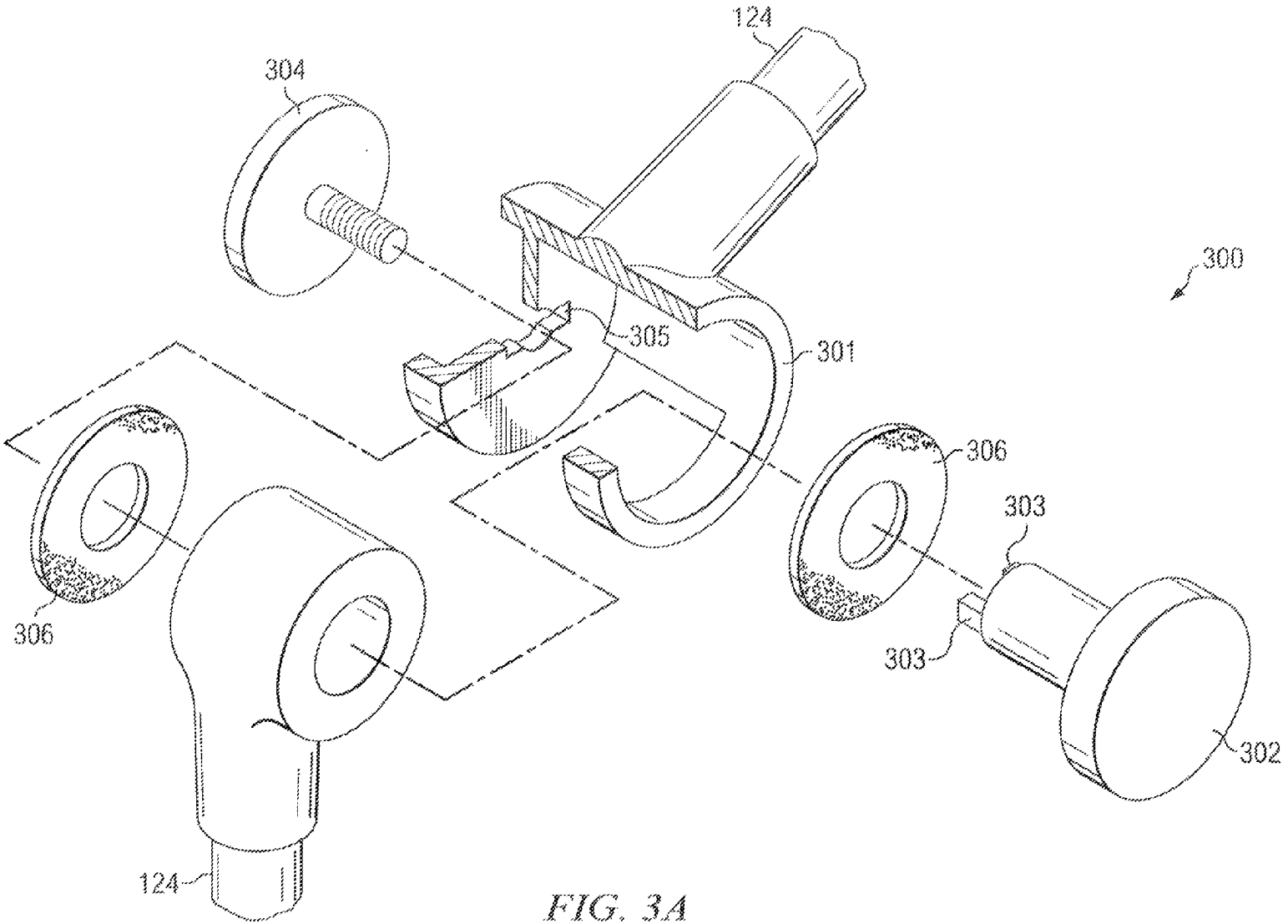
FIGS. 3*a* and 3*b* provide two views of the support arm knuckle assembly from a head-on angle and a side view angle, according to certain embodiments of the present invention.

Upper lamp pivot 121 may be a hinge or ball joint that allows a user to adjust the angle of lamp 110 relative to the countertop or food item. Upper lamp pivot 121 may be a hinge with some freedom to rotate about the lengthwise axis of arm member 124. Upper lamp pivot 121 may include a channel housing two or more electrical wires, which provide power to lamp 110. This channel may be enclosed. Upper lamp pivot 121 may incorporate one or more friction elements (c.a., friction washers or pads) to allow lamp 110 to maintain a set orientation after the user makes an orientation adjustment. Upper lamp pivot may include tabs and key slots (as illustrated in FIG. 3*a*) to limit vertical rotation of lamp 110 to about zero to 45° from vertical.

Elbow 122 may be a hinge or ball joint that allows a user to adjust the flex of support arm 120, which allows extension of arm 120. In some embodiments, elbow 122 allows for variable adjustment of the separation of lamp 110 from a surface or food item and may include friction elements to allow elbow 122 to maintain a particular separation set by a user. Elbow 122 may include a channel housing two or more electrical wires, which provide power to lamp 110.

Lower lamp pivot 123 may be a hinge or ball joint that allows a user to adjust the angle of support arm 120 relative to base 130. Lower lamp pivot 123 may be a hinge with some freedom to rotate about the lengthwise axis of arm member 124. Lower lamp pivot 123 may include a channel housing two or more electrical wires, which provide power to lamp 110. This channel may be enclosed. Lower lamp pivot 123 may incorporate one or more friction elements (e.g., friction washers or pads) to allow support arm 120 to maintain a set orientation after the user makes an orientation adjustment. Lower lamp pivot 123 may also incorporate locking recess 134. Lower lamp pivot 123 may also incorporate a power disconnect switch 135 (e.g., a micro switch) that may be engaged by a tab on one portion of the pivot such that when the angle of lower lamp pivot passes a threshold (e.g., 30° from vertical), the switch disconnects power to the infrared emitter. This pivot switch prevents the heat lamp from being energized in a stowed position.

Arm members 124 provide support for lamp 110. Arm members 124 may be hollow tubes (e.g., round or square)

providing a channel for at least two electrical wires (a hot and a neutral), which provide power to lamp 110. Arm members may be made from a light, stiff material like aluminum. Arm members 124 may have a fixed length or may include nested members to enable telescopic extension.

Base 130 may be a clamp or other attachment to a countertop or other existing surface. Base 130 may incorporate weights or heavy materials to provide stability and tip-over protection. Base 130 further includes power control 131, over-current protector 132, tip-over switch 133, and locking recess 134. Power control 131 allows a user to activate or deactivate lamp 110. Power control 131 may be an electromechanical switch or may be a microprocessor controlled switch with a user input mechanism. Power control 131 may include input for selecting from a fixed or continuous range of output levels. In some embodiments, power control 131 is a simple on/off switch. In other embodiments, power control 131 is a multiple position switch, for example, with settings for off low output, and high output. In still other embodiments, power control 131 allows a user to set an output intensity or a target food temperature, selected from a range of intensities or temperatures. In some embodiments, power control 131 includes a timer mechanism for automatically shutting off power to lamp 110 after a specified duration of time, e.g., a specified number of hours. In some embodiments, power control 131 incorporates a proximity sensor. In certain embodiments, the proximity sensor may temporarily turn off power to lamp 110 while a user has his hands under lamp 110, for example to serve himself some food. In certain embodiments, the proximity sensor may turn off power to lamp 110 after a predetermined amount of time has passed since a user has been in proximity to the heat lamp, e.g., the proximity sensor attempts to sense that the party is over.

Over-current protector 132 detects an interrupts an excessive current situation. Over-current protector 132 may be a single-use fuse, resettable fuse, or a circuit breaker. Tip-over switch 133 detects a dangerous tip-over condition (e.g., tip-over past a predetermined threshold) and disconnects power to lamp 110 to prevent a possible fire hazard. Tip-over switch may be a mercury switch, a ball contact switch, or other design. Tip-over switch may be calibrated to open when base 130 is tilted more than approximately 30°. Tip-over switch 133 may be a spring-loaded, plunger actuated switch mounted on the underside of base 130. When base 130 is flush with a countertop, the plunger is forced into a recess, which closes the switch. When base 130 tips over or is lifted from the countertop, the plunger will extend, thus opening the switch.

Temperature may also be controlled through the use of a remote temperature monitor that is placed proximate the food or target so as to more accurately monitor the temperature of the food or target. A temperature control may then be set to turn on and/or control the intensity of the infrared emitter when the remote temperature monitor senses a temperature below a threshold that may be set by the operator. The remote temperature monitor may comprise a probe or any other device known for this purpose.

Locking recess 134 provides a channel for accepting and retaining arm member 124, e.g., for storage or shipment. Locking recess 134 may incorporate a spring-loaded locking mechanism to retain arm member 124. In some embodiments, a retaining strap is provided to hold arm member 124 securely in locking recess 134. In some embodiments, a power disconnect switch is incorporated into locking recess 134 to automatically disconnect power when the heat lamp is stowed.

FIG. 2 illustrates a cross-sectional view of a portion of a heat lamp, according to certain embodiments of the present invention. Lamp 110 includes handle 111, outer shade 112, chimney 113, grille 114, upper lamp pivot 121, infrared emitter 201, first reflector 202, second reflector 203, outer air gap 204, vents 205, inner air gap 206, wire channel 210, barrel nut 211, wire channel 212, thermal cut-off switch 213, and infrared radiation path 214.

Infrared emitter 201 converts electrical energy to infrared radiation. In some embodiments, infrared emitter 201 is designed to generate far infrared radiation with wavelengths in the range of about 2.7 to about 5.92 micrometers as target foods absorb radiation at these wavelengths. In some embodiments, infrared emitter 201 is an iron-chrome-aluminum heating element wrapped in ceramic fiber insulation. In some embodiments, infrared emitter 201 is composed of an open ceramic insulator supporting a nichrome coil. In some embodiments, infrared emitter 201 may be a quartz tube. In still other embodiments, infrared emitter 201 may be an infrared light bulb. Infrared emitter 201 may be round, square, rectangular, cylindrical, or any other shape. Infrared emitter 201 may be replaceable or permanently installed into lamp 110. Infrared emitter 201 provides a means for generating infrared radiation that can be used to heat an intended target, e.g., prepared food.

In some embodiments, infrared emitter 201 features a ceramic heating element that generates infrared (electromagnetic radiant infrared energy) to transfer heat energy via invisible electromagnetic energy waves. Using the ceramic heating element to provide the heat may be advantageous because it delivers an even, gentle heat and zone control (i.e., the ceramic element generates infrared energy that is absorbed solely at the area it is directed). Furthermore, electric infrared may produce virtually instant heat, without the need to wait for heat buildup. Infrared heating, is not generally dependent upon air movement like convection heat. Additionally, the ceramic heating element that provides electric infrared heat may be one of the cleanest methods of heating. There are no by-products of combustion and the heating element adds nothing to nor takes anything from the air. In this way, a ceramic heating element helps maintain the flavors of the foods the heat lamp is warming. The infrared emitter may be a custom-built part or a light bulb. The custom part may be a coil of resistance wire (such as is commonly used in a toaster or a space heater) that glows red when energized. The resistance wire may emit electromagnetic energy across a broad spectrum with the predominant energy being infrared.

In some embodiments, some infrared radiation from infrared emitter 201 is directed generally upward or sideways toward outer shade 112 rather than generally downward toward the food. This misdirected energy would be wasted if allowed to continue in that direction and could contribute to a dangerous heating of outer shade 112 and handle 111. First reflector 202 reflects at least some of this misdirected infrared radiation generally downward toward the food to be heated. In some embodiments, outer air gap 204 exists between outer shade 112 and first reflector 202 to allow convective air flow out vents 205, which cools outer shade 112 and first reflector 202 and prevents conductive heating of outer shade 112 via hot stagnant air trapped between outer shade 112 and first reflector 202. In some embodiments, outer air gap 204 is filled, at least in part, with an insulating material. In some embodiments, outer shade 112 and first reflector 202 are connected in an airtight manner (thus forming a double-walled chamber) with a substantial amount of the air in air gap 204 evacuated to form a vacuum insulator.

In some embodiments, first reflector 202 is a generally reflective, generally continuous, metal shield (e.g., thin rolled steel or aluminum) wrapped around the sides and much of the top of infrared emitter 201 leaving air gap 206 between first reflector 202 and infrared emitter 201. In some embodiments, first reflector 202 may include a series of louvers at or near the top of first reflector 202. The louvers may reflect infrared radiation downward at an angle. The louvers may allow convective air flow to pass through. In some embodiments, the louvers are arranged radially. In some embodiments, first reflector 202 may be formed from a heat-safe material (e.g., an engineering plastic) coated with a reflective foil or paint. Air gap 206 allows convective air flow around infrared emitter and out chimney 113 to prevent conductive heating of first reflector 202 via hot stagnant air trapped between first reflector 202 and infrared emitter 201.

In some embodiments, second reflector 203 is provided to prevent leakage of infrared radiation through inner air gap 206 and out chimney 113. Second reflector 203 may be positioned to reflect radiant energy downward while still maintaining inner air gap 206 and allowing, convective air flow through inner air gap 206 and out chimney 113. For example, infrared radiation may follow path 214 upward from infrared emitter 201 before being reflected by second reflector 203 and then first reflector 202. In some embodiments, second reflector 203 is a generally reflective, generally continuous, metal shield (e.g., thin rolled steel or aluminum) wrapped around the top of infrared emitter 201. In some embodiments, second reflector 203 may be formed from a heat-safe material (e.g., an engineering plastic) coated with a reflective foil or paint. In some embodiments, second reflector 203 is formed from a series of louvers. The louvers may reflect infrared radiation downward at an angle. The louvers may allow convective air flow to pass through. In some embodiments, the louvers are arranged radially. The combination of one or more reflectors provides a means for reflecting infrared radiation toward an intended target that increases the efficiency of the heat lamp and reduces heating of the outer shade and handle. In certain embodiments, second reflector 203 may rotate to aid in ventilation of the high temperature components.

In some embodiments, the only mechanical coupling between outer shade 112 and the high temperature components (e.g., infrared emitter 201 and reflective shades 202 and 203) is chimney 113. As illustrated in FIG. 2, no direct contact exists between the high temperature components and outer shade 112, thereby preventing conduction of heat to outer shade 112. However, because chimney 113 does have direct contact with the high temperature components, it should be constructed from a material that remains solid, inflammable, and structurally sound at temperatures generated by the high temperature components—e.g., infrared emitter 201 and reflectors 202 and 203—after prolonged operation of heat lamp 100.

Figure 2A:
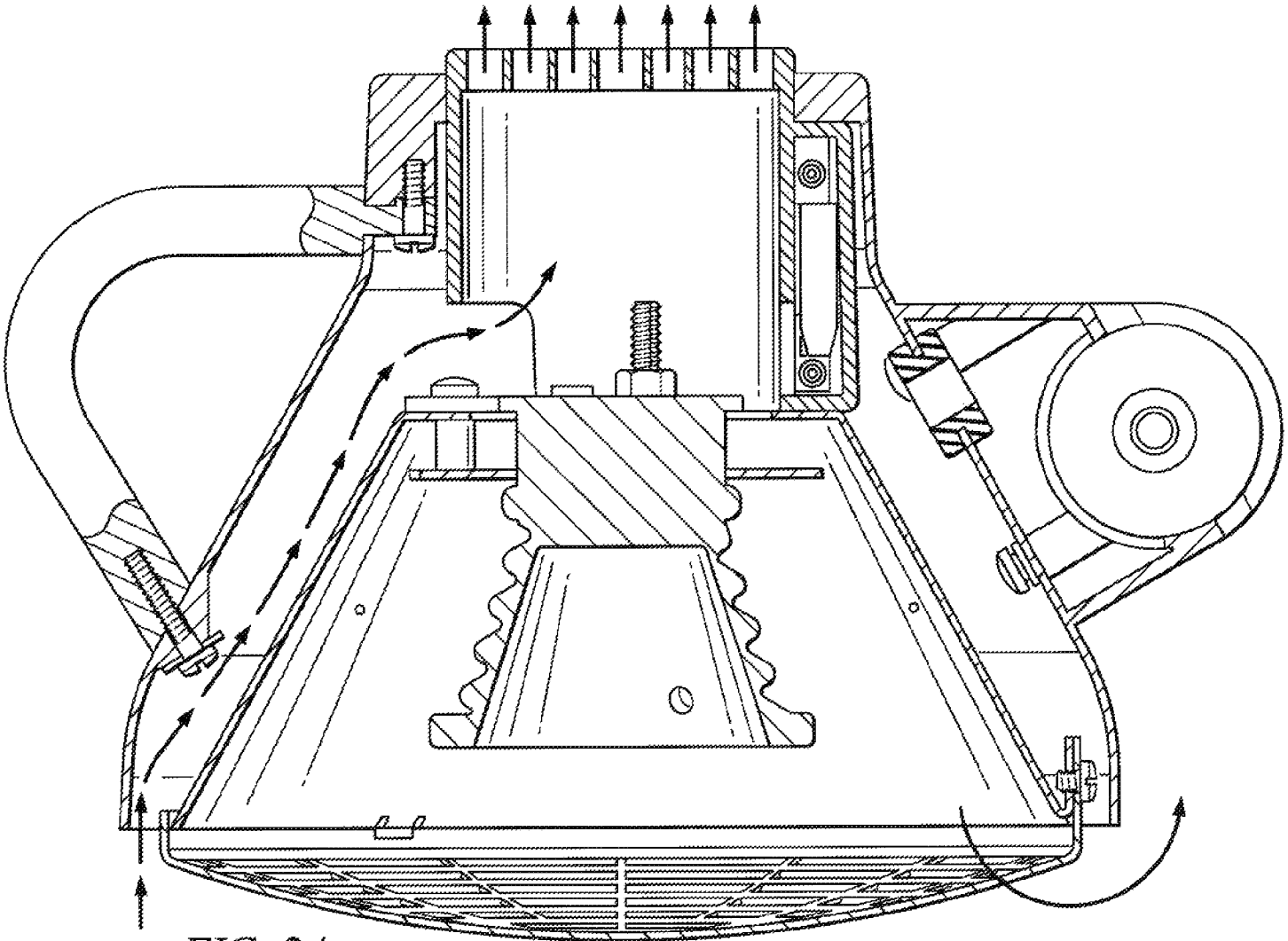

Vents 205 allow heated air to escape out the top of lamp 110. In some embodiments, a single vent 205 may accommodate chimney 113 to allow heated air to escape only through chimney 113, as shown in FIG. 2A. In some embodiments, one or more vents 205 may allow heated air to escape out the top of lamp 110 without traveling through chimney 113, e.g., directly through air gap 204 and through vents 205. In some embodiments, one or more vents 205 may allow ambient air to be pulled from air space 204 to mix with heated air moving through chimney 113, thereby reducing its temperature.

FIG. 2 also illustrates various electrical features, according to certain embodiments of the present invention. Wire channel 210 may accommodate two or more wires, which may connect components of lamp 110 to components of base 130. Wire channel 210 may be completely or partially enclosed. In some embodiments, wires housed in wire channel 210 will flow over keyed barrel nut 211, which allows limited rotation of upper elbow 121, but prevents crimping of the wire. Wire channel 210 may continue through grommet 212 to bring wires in contact with infrared emitter 201 and thermal-cutoff 213.

Thermal-cutoff 213 causes an automatic disconnect of power to infrared emitter 201 in the event of an over-temperature condition. Thermal-cutoff 213 may protect internal components from dangerous temperatures in order to prevent or diffuse a fire hazard. Under normal operating conditions, convective airflow passes through air gaps 204 and/or 206, cooling the internal components and maintaining safe operating conditions. In one abnormal circumstance, where vents 205 and chimney 113 become blocked, operation of infrared emitter 201 may cause dangerous temperatures to form within lamp 110 as no convective airflow would be possible. In another abnormal circumstance, if the open end of lamp 110 (i.e., the end with grille 114) were to come in contact with a surface, especially a soft surface, that contact could restrict or block convective airflow. A significant restriction or blockage of airflow through air gaps 204 and/or 206 could result in a dangerously high internal temperature, possibly causing fire, structural damage, and/or breakdown of electrical insulators. Because of the arrangement of air gaps 204 and 206, heat lamp 100 can indirectly "sense" the airflow restriction and shut down the infrared emitter before a dangerous condition occurs. In some embodiments, thermal cutoff 213 may be thermally insulated from outer shade 213 to react to the air temperature in air gap 204. In some embodiments, thermal-cutoff 213 may be thermally connected to outer shade 213 to react to the shade temperature.

Thermal-cutoff 213 may be a single use or resettable thermal-cutoff device. In some embodiments, thermal-cutoff 213 utilizes a thermal pellet, e.g., made of wax, that normally compresses a spring, holding an electrical switch closed. Once the temperature exceeds a predetermined threshold temperature, the wax melts, thereby releasing the spring and opening the switch. In some embodiments, thermal-cutoff 213 utilizes a bimetal thermal protector, which may allow for automatic self-reset once the temperature has decreased. In some embodiments, thermal-cutoff 213 may be implemented using a temperature sensor (e.g., a thermocouple) combined with a controller and a controllable switch. In certain embodiments, multiple thermal-cutoff devices may be utilized. In some embodiments, a mechanically operated thermal-cutoff to provide a high threshold fail-safe may be combined with a lower threshold control circuit. In some embodiments, two mechanically operated thermal-cutoff devices may be wired in series, one being automatically resettable with a lower threshold and one being a single-shot device with a higher threshold. Thermal cut-off 213 provides a means for preventing or interrupting a thermal overload condition. In some embodiments, the threshold temperature for thermal cut-off 213 may be set to a temperature at which a user may be burned by escaping gases or by brief contact with the outer shade. In some embodiments, the threshold temperature for thermal cut-off 213 may be set to a fraction of the melting or plastic point of chimney 113 to prevent melting or deformation of the same, even if the remaining heat energy continues to heat chimney 113 after emitter 201 has been turned off.

Figure 3B:
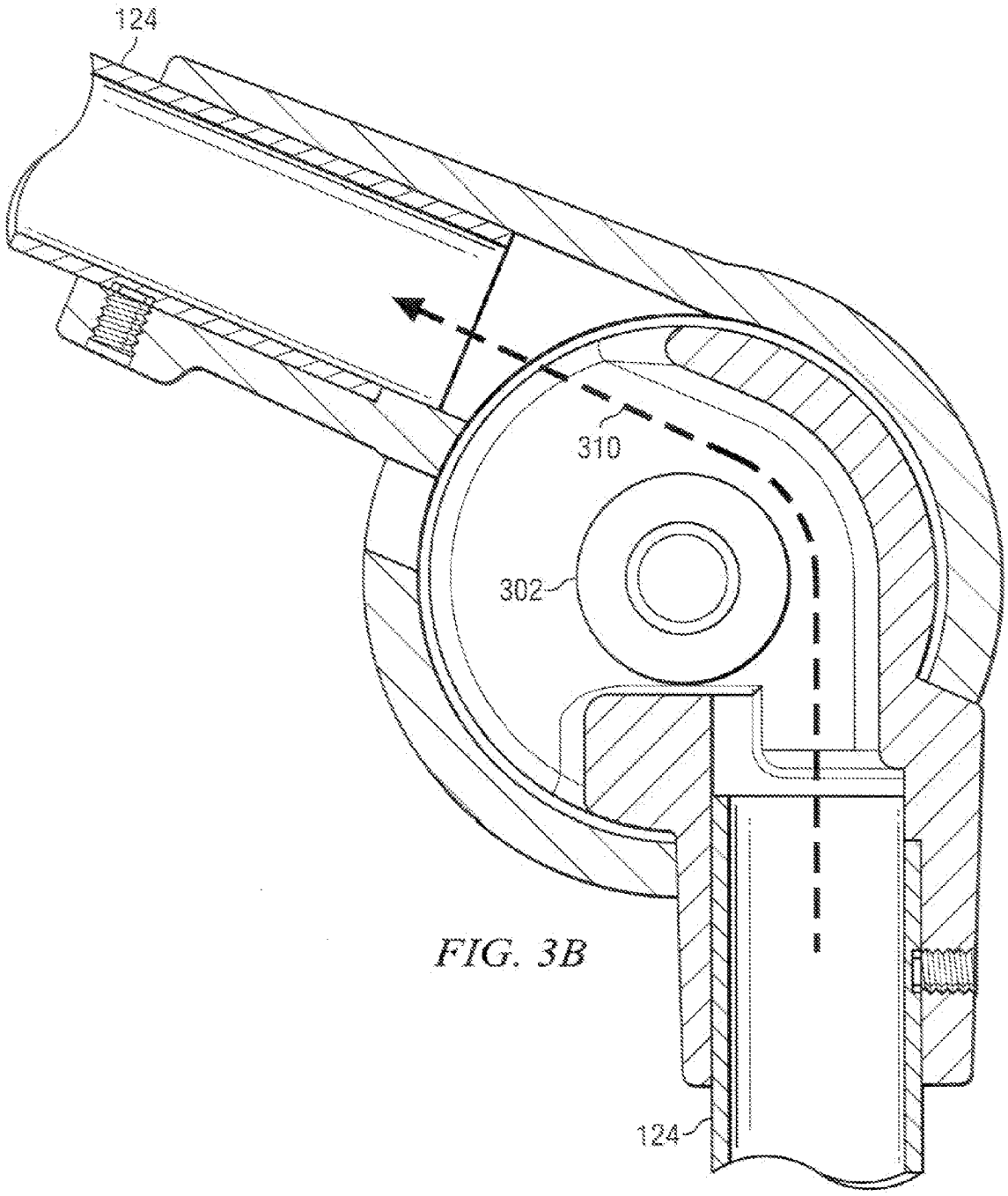

FIGS. 3*a* and 3*b* provide two views of the support arm knuckle assembly from a head-on angle and a side view angle, according to certain embodiments of the present invention. FIG. 3*a* illustrates a cut-away, head-on view of knuckle assembly 300. Knuckle assembly 300 allows the support arm to bend within a predetermined range of motion, e.g. from about a 10° spread (e.g., a storage position) to about a 130° spread. In some embodiments, a maximum spread of about 180° may be allowable. Knuckle assembly 300 may allow for discrete opening settings or continuous adjustment, within the predetermined range of motion. Knuckle assembly 300 includes outer housing 301, barrel nut 302 (with tabs 303), screw 304, housing key slots 305, and friction washers 306.

Outer housing 301 may be constructed in two interconnecting pieces, one connecting to upper arm member 124 and the other connecting to lower arm member. Joining those two pieces is barrel nut 302 and screw 304, together providing compressive force on the two interconnecting pieces. Barrel nut 302 includes tabs 303 that fit into housing key slots 305 to allow a limited range of motion of knuckle assembly 300. Friction washers 306 prevent unintended movement of knuckle 300 by countering the gravitational force generated by lamp 110. Instead of friction washers 306, additional tabs and slots may be provided in barrel nut 302 and outer housing 301 to allow for discrete extension positions. In some embodiments, the user would loosen screw 304 to adjust knuckle assembly 300. In other embodiments, a spring may be provided to allow the additional tabs to move to the next slot by compressing the spring. In other embodiments of the invention, stops may be mounted in the knuckle housing to prevent the knuckle assembly 300 from rotating past 180 degrees.

FIG. 3*b* illustrates a cut-away side view of knuckle assembly 300 illustrating cable pathway 310. Cable pathway 310 may be completely or partially enclosed and may wrap around barrel nut 302. Because barrel nut 302 may be keyed into outer housing 301 (as described above), wires in cable pathway 310 are protected from shearing or crimping forces that would otherwise be applied if knuckle assembly 300 were extended past about 180°.

In some embodiments, the features of knuckle assembly 300 are incorporated into upper lamp pivot 121 (and lower lamp pivot 123). In these embodiments, the range of extension of upper lamp pivot 121 may be limited to always maintain a slight cant to lamp 110, even when stowed. In this way, airflow is never completely restricted through lamp 110, allowing efficient cooling even after the lamp is turned off and stowed. In some embodiments, a fan is incorporated into base 130 forcing air through a channel in support arm 120 and into lamp 110 to assist in cooling lamp 110. In alternative embodiments, the convective flow is reversed and a fan is located in the lamp 100 to direct air downward toward the target. Placement of the fan in the base may allow for a larger, more powerful fan and it would not be as likely to overheat because it would not be proximate the infrared emitter. A fan in the base may either push or pull the air through the armature.

Figure 4:
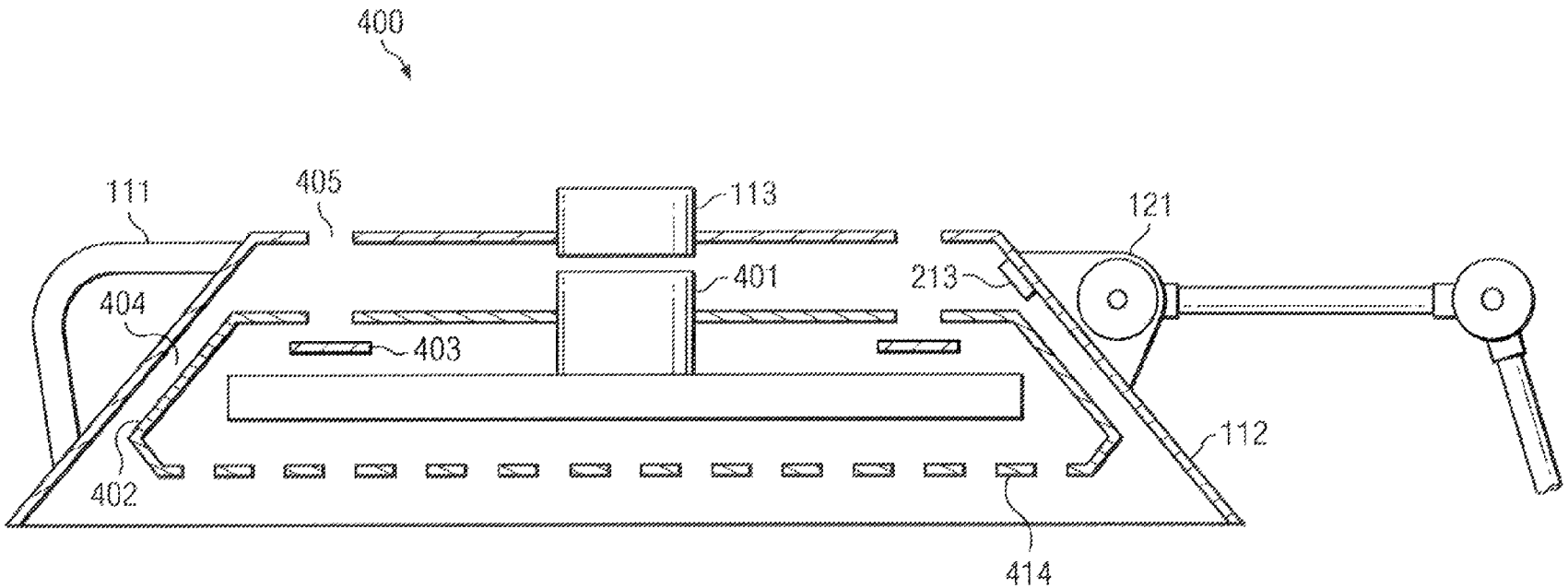
FIG. 4 illustrates a side, cross-sectional view of a heat lamp, according to certain embodiments of the present invention.

FIG. 4 illustrates a side, cross-sectional view of a heat lamp, according to certain embodiments of the present invention. Oblong lamp 400 includes infrared emitter 401, first heat shield 402, second heat shield 403, air gap 404, vents 405, and screen 414. Upper lamp pivot 121 may be attached to a short side or a long side of oblong lamp 400. In some embodiments, oblong lamp 400 may include multiple infrared emitters 401. In certain embodiments, oblong lamp 400 may include an oblong infrared emitter 401. In some embodiments, additional chimneys 113 may be provided, e.g., at each vent 405.

Figure 5:
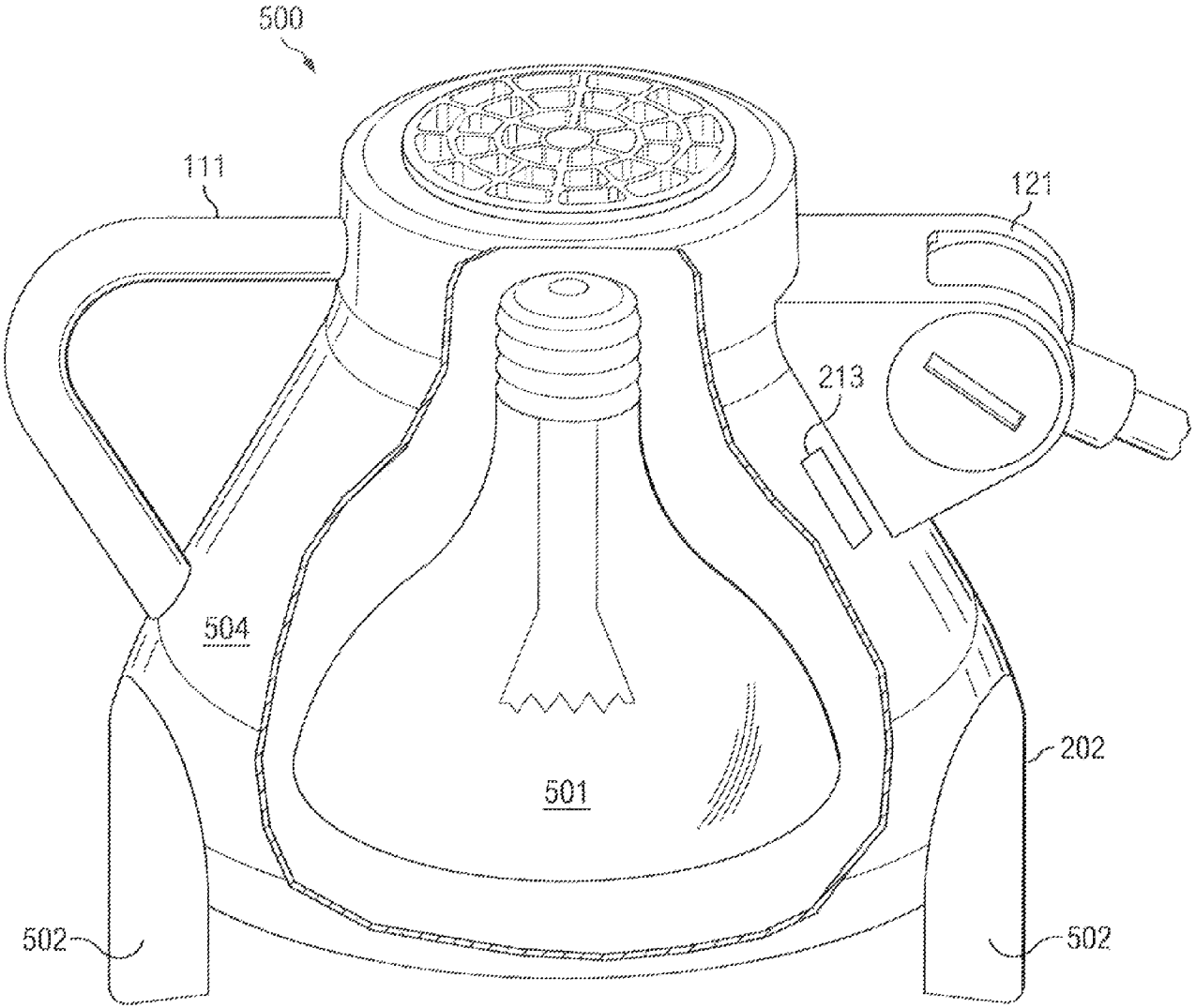
FIG. 5 illustrates a side, cross-sectional view of a heat lamp, according to certain embodiments of the present invention.

FIG. 5 illustrates a side, cross-sectional view of a heat lamp, according to certain embodiments of the present invention. Lamp 500 includes infrared bulb 501, bulb positioning fins 502, and air gap 504. Infrared bulb 501 may be a glass bulb with a filament. Infrared bulb 501 may emit visible light as well as infrared light. Bulb partitioning fins 502 may maintain a generally uniform air gap 504 around infrared bulb 501 by physically contacting infrared bulb 501 in at least one place. Bulb partitioning fins 502 may also extend beyond shade 112 and/or infrared bulb 501 to provide impact protection. Because bulb partitioning fins 502 may create very tight tolerances, the bulb socket may need to be flexibly mounted to allow for some motion while a bulb is inserted or extracted. In certain embodiments, shade 112 of lamp 500 may be made from cold rolled steel. In certain embodiments, shade 112 of lamp 500 may be made from plastic (e.g., glass filled nylon 6).

Figure 6:
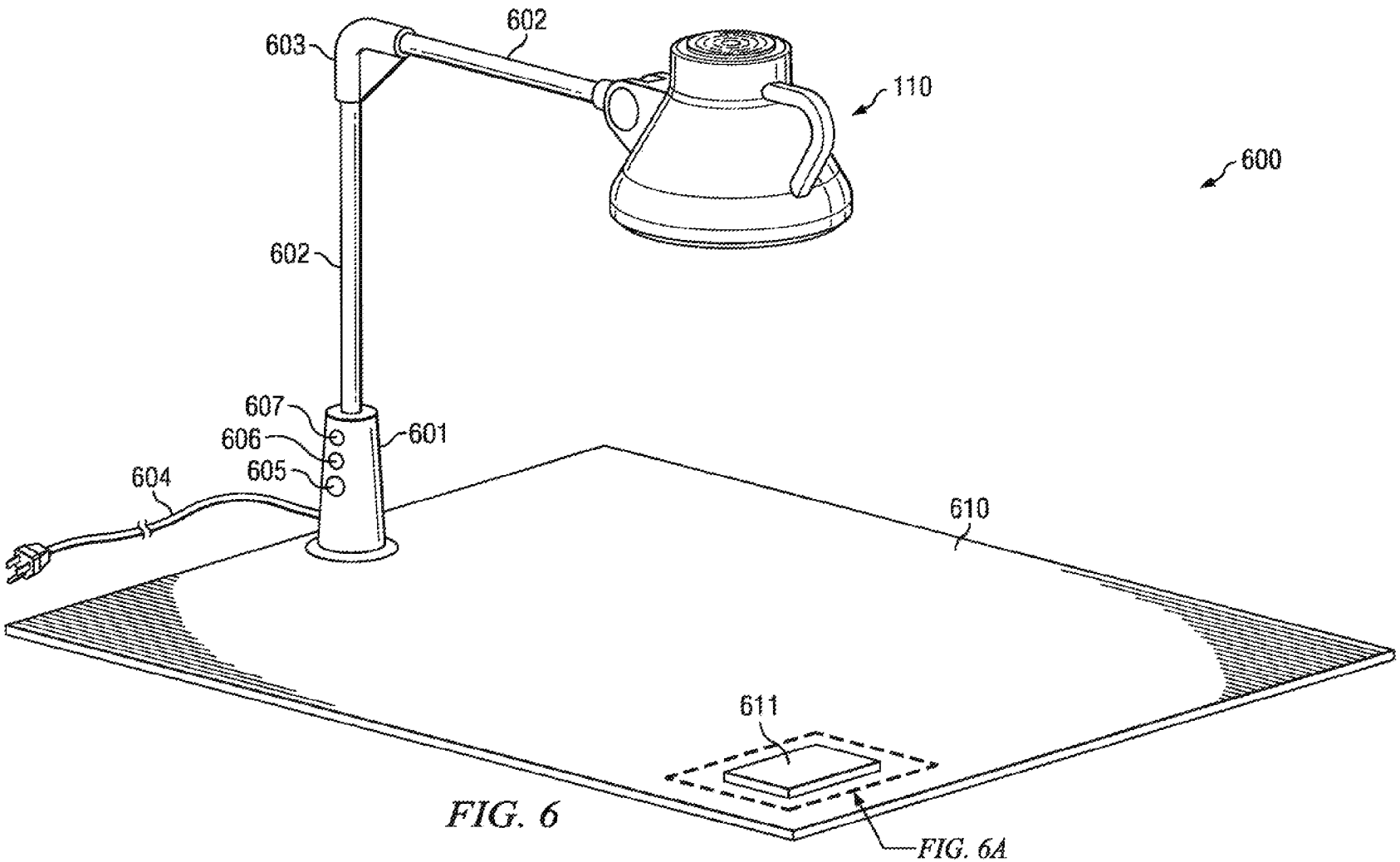
FIGS. 6 and 6A illustrate views of a heat lamp, according to certain embodiments of the present invention.

FIG. 6 illustrates a view of a heat lamp, according to certain embodiments of the present invention. Heat lamp 600 includes lamp 110, base 601, arm members 602, arm elbow 603, and foundation 610. In certain embodiments, arm elbow 603 maintains a fixed angle between arm members 602. In certain embodiments, arm elbow 603 is made from two generally triangular pieces attached together to form two generally perpendicular channels for receiving arm members 602. In some embodiments of the invention, the height of the lamp 110 relative to the base 610 may be adjustable.

Base 601 houses certain components of heat lamp 600 and provides a structural connection to foundation 610. Base 601 provides a channel for receiving arm member 602 and connects to foundation 610 to provide indirect lateral support for lamp 110. Base 601 includes a channel for receiving power cord 604, convenience outlet 605, circuit breaker 606, and tip-over switch 607. Convenience outlet 605 allows a user to connect a second heat lamp 600 to form a series of daisy-chained lamps, e.g., in a buffet line. In some embodiments, circuit breaker 606 provides over-current protection for heat lamp 600 by disconnecting lamp 110 in the event that current through the wires to lamp 110 exceeds a predetermined level. In some embodiments, circuit breaker 606 disconnects power to lamp 110 and convenience outlet 605 in the event that current received through power cord 604 exceeds a predetermined level.

Foundation 610 provides a stable platform for heat lamp 600 and a convenient interface for user interaction and control. In some embodiments, foundation 610 may be a thin base generally as large as the infrared output pattern produced by lamp 110. In some embodiments, foundation 610 may be larger than the infrared output pattern to protect the surface below lamp 110. In certain embodiments, foundation 610 may be thermally insulated and/or opaque to protect an underlying countertop or furniture surface from the high food temperature and/or infrared radiation. Silicone pads may also be used on the bottom of the foundation to protect a countertop. In certain embodiments, foundation 610 may be reflective to protect the countertop or furniture surface without absorbing heat, which would increase the temperature of foundation 610. To protect the countertop or furniture surface, foundation 610 may need to be as broad as the primary heating area under lamp 110, for example at least 16 inches in each horizontal dimension if a circular infrared emitter is 15 inches above foundation 610. In some embodiments, foundation 610 is large enough to accommodate a standard 9" by 13" casserole dish.

The foundation 610 may also comprise a storage compartment for a variety of accessories including, for example, spare or replacement infrared radiation bulbs, serving utensils, etc. One aspect of the invention comprises serving utensils that remain cool to the touch in the presence of infrared energy. Serving utensils may be made of silicone or any material that that does not absorb infrared energy or that does not become hot in the presence of infrared energy.

According to alternative embodiments of the invention, the foundation 610 comprises a hot plate so as to heat the target both from the infrared radiation above and the hot plate below. Any hot plate structures known in the art may be incorporated and used in the foundation. In one embodiment, the foundation 610 may comprise a heater element that may be an etched foil design element comprising circuitry for a Kapton™/Polyimide heater. The heater element may be constructed of a material that is a polyimide polymer, for example, a Kapton™ material. Note that Kapton™ is a trademark of the DuPont™ Corporation. A Kapton™ material, in film form, can provide enhanced dielectric strength in very thin cross sections and very good bonding and heat transfer capabilities. Use may be made of a Kapton™ film having a thermal conductivity below 0.5 W/mK and a dielectric strength exceeding 1250 V, which can be achieved with a thickness between 0 and 100 μm. The heater can therefore be implemented as a Kapton™ type heater. Note that resistive heater element may be implemented as a Kapton™ type heater or a heater formed of a polyimide polymer, depending upon design considerations.

Kapton™/Polyimide heaters made with this DuPont™ thin film may be transparent, lightweight, flexible and are electrically strong. Kapton™/Polyimide may be compatible with foil element alloys such as inconel, nickel, copper, and stainless steel. They may have low outgassing properties, may be resistant to solvents. They may work well with adhesive systems that permit higher operating temperatures. Thermal control and sensing devices may be incorporated into the hotplate.

The hotplate may comprise a thin outer layer of Kapton™ (first insulating film) and a thicker layer of Kapton™ (second insulating film) between which two layers there is a layer of electrically conductive material (heater element). The layer of electrically conductive material could be formed by vacuum depositing a layer of conductive material onto the second insulating layer and then bonding the first insulating film to the layer by way of layers of adhesive material. Adhesive layers may be painted onto the insulating film layers.

Heater element may be a deposited ink on a dielectric that is bonded to a metal substrate. Once energized, the conductive inks may provide the heat source to elevate the soleplate temperature. The ink pattern may be two side-by-side undulating ink deposit strands similar to the strands. The ink strands may connect to form one continuous electrically resistant heat generating ink coil that is bonded to a metal substrate.

Figure 6A:
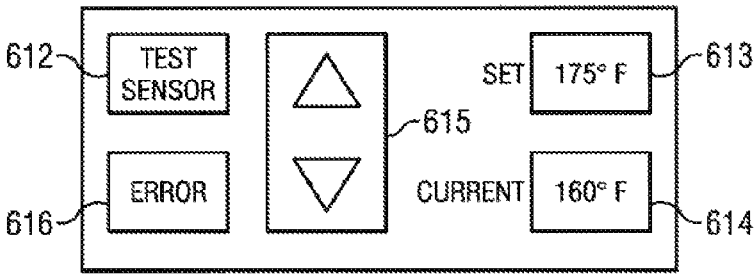

Foundation 610 may include control panel 611 (illustrated in FIG. 6A). Control panel 611 may include temperature sensor 612, set point indicator 613, current temperature indicator 614, set point adjustment interface 615, and error indicator 616. Temperature sensor 612 provides feedback for adjusting the output of lamp 110. In some embodiments, temperature sensor 612 may be positioned and designed to sense the temperature of food placed under lamp 110. In some embodiments, temperature sensor 612 may attempt to sense the likely heating level of lamp 110. For example, temperature sensor 612 may incorporate material with absorption characteristics similar to food and may be positioned within the infrared radiation pattern. In some embodiments, the value read from temperature sensor 612 may be used to automatically control the output of lamp 110. In some embodiments, temperature sensor 612 may be remote from, e.g., a probe that may be placed on or in the food to be heated.

Set point indicator 613 indicates the desired output or target temperature for lamp 110. In some embodiments, set point indicator 613 provides a display of a temperature value. In some embodiments, set point indicator provides a discrete output level indicator (e.g., high/low or a range of multiple discrete output levels).

Current temperature indicator 614 indicates the current temperature as measured by temperature sensor 612. In some embodiments, current temperature indicator 614 displays the current temperature as a numeric value. In some embodiments, current temperature indicator 614 displays the current temperature as a value on a range, e.g., a bar graph indicator. In some embodiments a color scheme may indicate a danger zone temperature as a red background or with a red light.

Set point adjustment interface 615 allows a user to adjust the set point. In some embodiments, set point adjustment interface 615 is a switch or knob. In some embodiments, set point adjustment interface 615 is a pair of buttons or touch sensors, one for increasing the set point and one for decreasing the set point.

Error indicator 616 provides a display of recognized error conditions. In some embodiments, error indicator 616 warns a user of a high temperature condition in lamp 110, which has required or may soon require an automatic shutoff of lamp 110. In some embodiments, error indicator 616 warns a user of an unsafe food temperature condition, e.g., one signaled by a low reading at temperature sensor 612.

Fan 620 provides active airflow adjustment. In some embodiments, fan 620 provides an active assist to the natural convective airflow by drawing additional cool air through lamp 110 and out the vents and/or chimney at the top of lamp 110. In some embodiments, fan 620 may blow air downward to overpower the natural convective airflow and force the heated air downward toward the food item. Fan 620 may be manually controlled or automatically controlled. Fan 620 may have multiple speeds to adjust for varied ambient temperature conditions or internal conditions. Fan 620 may be triggered by an over-temperature condition within lamp 110. The fan 620 may operate in any of three modes. First, the fan 620 may pull air past the heating element in the same direction as convention. Second, the fan 620 may push air down past the heating element in a direction opposite the direction of convection. Third, the fan 620 may direct air flow in a cross-wise direction relative to the direction of convection. For any of the modes of operation, the fan 620 may be located either upstream or down stream relative to the heating element and the direction of convection. Alternatively, the fan 620 may be positioned on the side of the outer shade so as to pressurize an enclosed space such that the outlet of that pressurization directs air either up (to reinforce convection) or down to improve heat delivered to the target.

Figure 8:
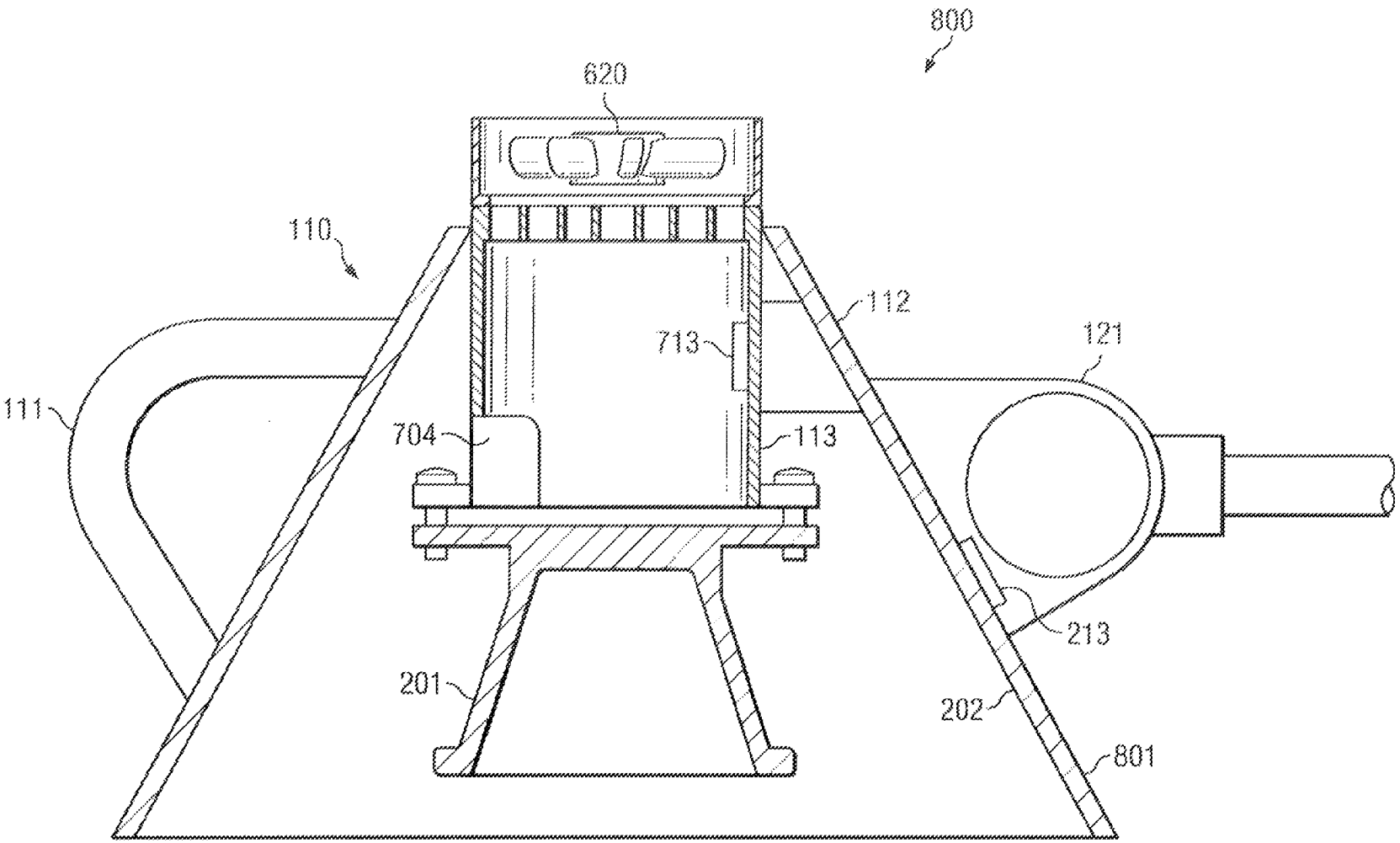
FIG. 8 illustrates a cross-sectional view of a portion of a heat lamp, according to certain embodiments of the present invention.

FIG. 8 shows a cross-sectional side view of a lamp embodiment of the present invention. As previously described, the lamp 110 comprises a handle 111 connected to an outer shade 112. An infrared emitter 201 is positioned inside the outer shade 112 and a chimney 113 extends within the outer shade 112 above the infrared emitter 201. An upper lamp pivot 121 is also connected to the outer shade 112. A fan 620 is positioned within the chimney 113. In some embodiments, fan 620 may be mounted on shade 112 away from chimney 113 to provide additional air flow without being subject to the high temperature of the chimney.

Figure 10:
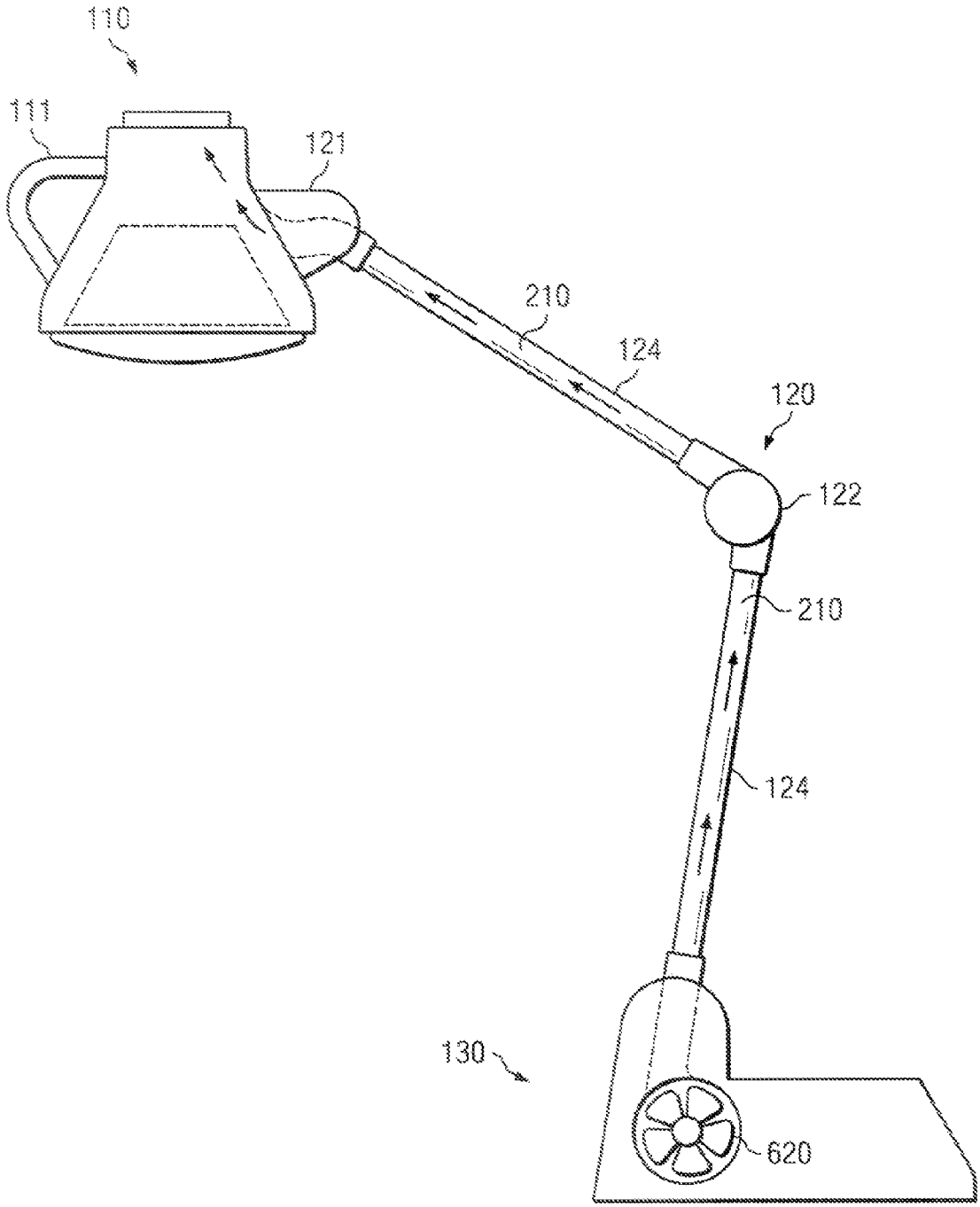
FIG. 10 illustrates a cross-sectional view of a heat lamp, arm, and base according to certain embodiments of the present invention.

FIG. 10 shows a cross-sectional side view of a lamp embodiment of the present invention. As previously described, FIG. 10 illustrates a heat lamp according to certain embodiments of the present invention wherein the heat lamp 100 includes lamp 110, support arm 120, and base 130. Each of the arm members 124 of the support arm 120 has a wire channel 210 within. Further, the elbow 122 and the upper lamp pivot 121 have internal conduits that allow air to flow. These components connect to form and internal conduit from the base 130 to the lamp 110. The base further comprises a fan 620 for moving air through the internal conduit. As previously discussed, the fan may pull the air down from the lamp toward the base, or push the air from the base to the lamp. Further, while the lamp is illustrated in FIG. 10 to have a configuration that would push air up the chimney, it may also be configured to push air out the bottom the lamp or push in both directions.

Figure 7A:
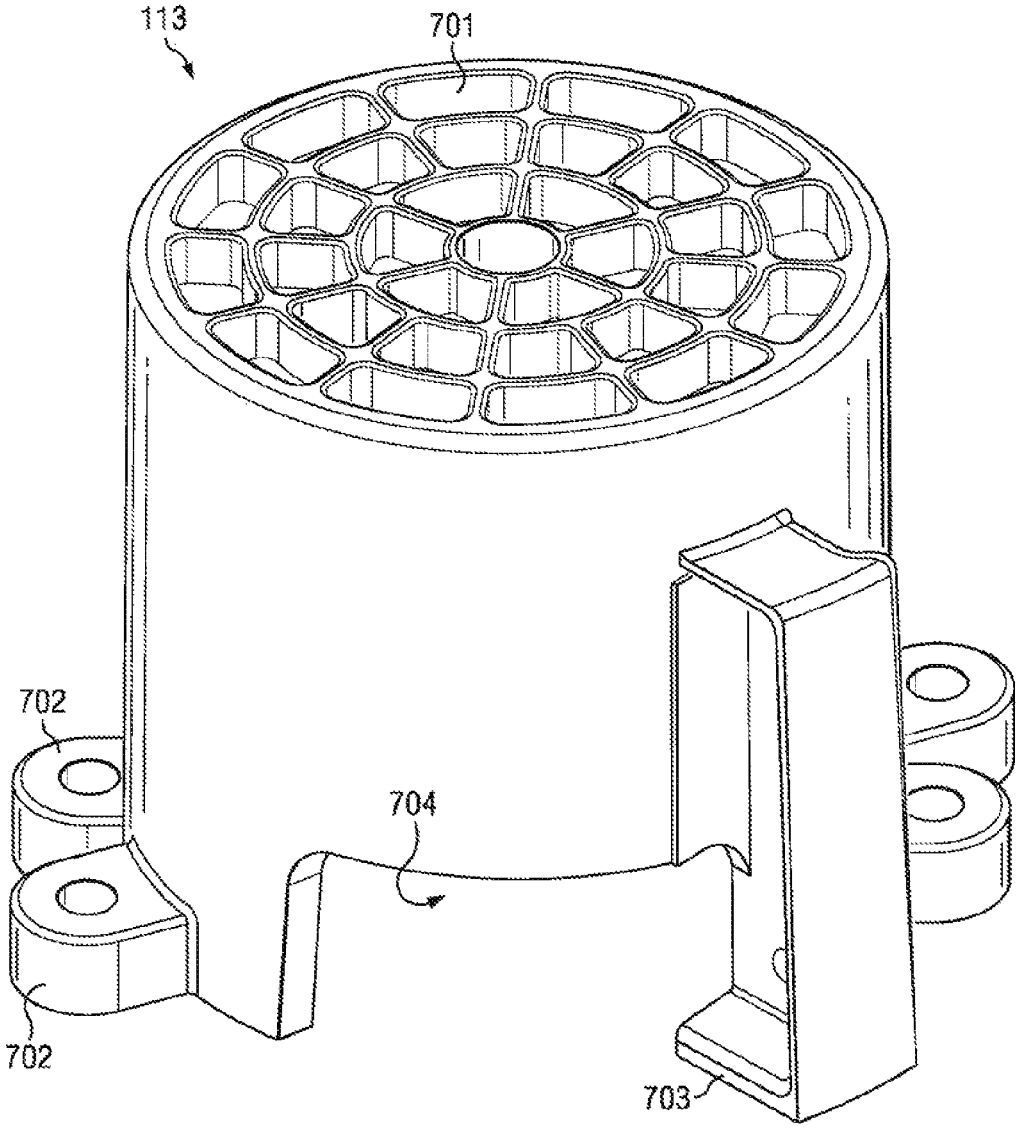
FIGS. 7*a* and 7*b* illustrate two slightly different views of chimney 113, according to certain embodiments of the present invention.
Figure 7B:
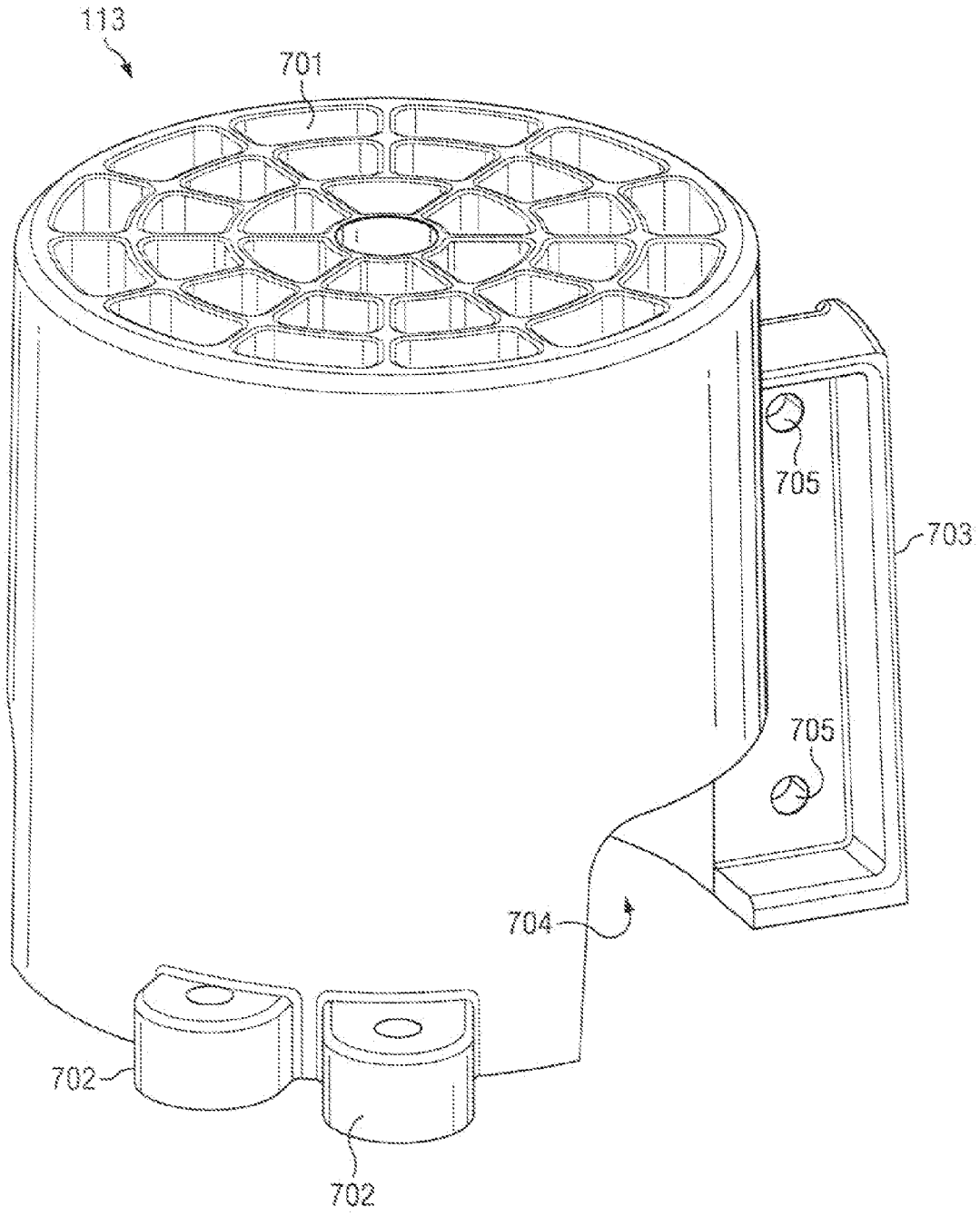

FIGS. 7*a* and 7*b* illustrate two slightly different views of chimney 113, according to certain embodiments of the present invention. Chimney 113 includes chimney grille 701, high-temperature mount points 702, outer shade interface 703, and side air port 704. In some embodiments, chimney 113 may be a one-piece, molded part made from an engineered plastic or other suitable material. In some embodiments, chimney 113 may be an assembly of multiple parts and materials with different thermal and structural characteristics.

Chimney grille 701 provides an external exhaust port for convective air flow while preventing insertion of foreign objects or other direct contact between internal, high-temperature components and people, pets, or things. High-temperature mount points 702 provide a direct interface between high-temperature elements (e.g., one or more of first heat shield 202, second heat shield 203, and infrared emitter 201). This direct interface allows chimney 113 to physically support and stabilize the high-temperature elements. Outer shade interface 703 provides a direct interface between chimney 113 and outer shade 112. Outer shade interface 703 allows outer shade 112 (and indirectly support arm 120) to support chimney 113 and, indirectly, the high-temperature components. In some embodiments, outer shade interface 703 extends from chimney 113 to maintain air gap 204.

Side air port 704 may allow air flow through air gap 204 into chimney 113 (see FIG. 2) to cool chimney 113 and lower the convective air temperature above lamp 110. Further, in the event that chimney grille 701 is obstructed, hot air may flow out of side air port 704 into air gap 204. This hot air flow may trip thermal-cutoff 213 (which may be mounted to mount points 705) and shut down the operation of lamp 110. In the event that lamp 110 is tilted too shallowly (approaching horizontal), convective air flow may be disrupted causing dangerous heating of external features. In this shallow orientation, convective air flow may begin to flow out side air port 704 rather than chimney 113, thus causing thermal-cutoff 213 (mounted at points 705) to trip. Chimney 113 provides a means for safely channeling high temperature convective air flows through the heat lamp.

FIG. 8 illustrates a cross-sectional view of a portion of a heat lamp, according to certain embodiments of the present invention. In some embodiments, lamp 110 includes a sandwich of outer shade 112 and first heat shield 202 that creates void 801. In some embodiments, void 801 is an insulating vacuum. In some embodiments, void 801 is filled with an insulating material such as ceramic, stranded fiberglass, high temperature foam, or silicone. In certain embodiments, side air port 704 allows convective air flow along infrared emitter 201 and through chimney 113. In certain embodiments outer shade 112 is formed, at least in part, of a thermally conductive material.

In certain embodiments, thermal-cutoff 213 may be mounted in thermal contact with outer shade 112 and configured with an appropriate threshold to maintain a safe temperature for that exposed surface. For example, a threshold may be set well below a temperature that might cause a contact burn in that outer shade 112 may continue to get hotter even after power is disconnected from infrared emitter 201. In some embodiments, thermal-cutoff 713 is mounted within chimney 113 in order to react to restricted or inadequate convective air flow through chimney 113.

The heater element may be an infrared source of the type that is energized very quickly. The heater element may comprise infrared quartz tubes. Any number of tubes may be positioned in any pattern. Further, the tubes may take any shape, for example, linear, arcuate, angled, figure C, figure S, square, circular, etc. Quartz tubes have electrical leads for electrically communicating with temperature control knob and electric cord. Tube clips may be mounted to the first heat shield for engagement with quartz tubes. Tube clips may suspend quartz tubes over a reflective material so as to disperse energy more evenly. The interior surfaces of the first heat shield may be coated with an infrared reflective coating to reflect energy emitted by quartz tubes toward the target. Examples of reflective coatings or materials include: gold, anodized aluminum or any other high temperature, low emissivity material. Other components may be coated with an infrared absorptive coating. Examples of absorptive coatings or materials include: ceramic, porcelain or any other high emissivity material.

The infrared source may be a tungsten type lamp. The infrared source may be used to quickly heat up the target. Quartz lamps may also be used. Quartz tubes may have a Watt density between about 65-120 Watts/linear inch. Quartz tubes may also have an internal gold reflector. Quartz tubes and quartz lamps may have the ability to reach maximum temperature very quickly, if not instantly. Further, quartz tubes and quartz lamps may reach maximum operating temperatures of 870° C. to 1370° C.

In some embodiments, head assembly 110 includes fan 620 for providing powered air flow through chimney 113. Fan 620 may pull heated air through chimney 113 or may push ambient air through chimney 113 towards emitter 201. In some embodiments, fan 620 may be mounted to outer shade 112, and outside of the flow of heated air.

Figure 9A:
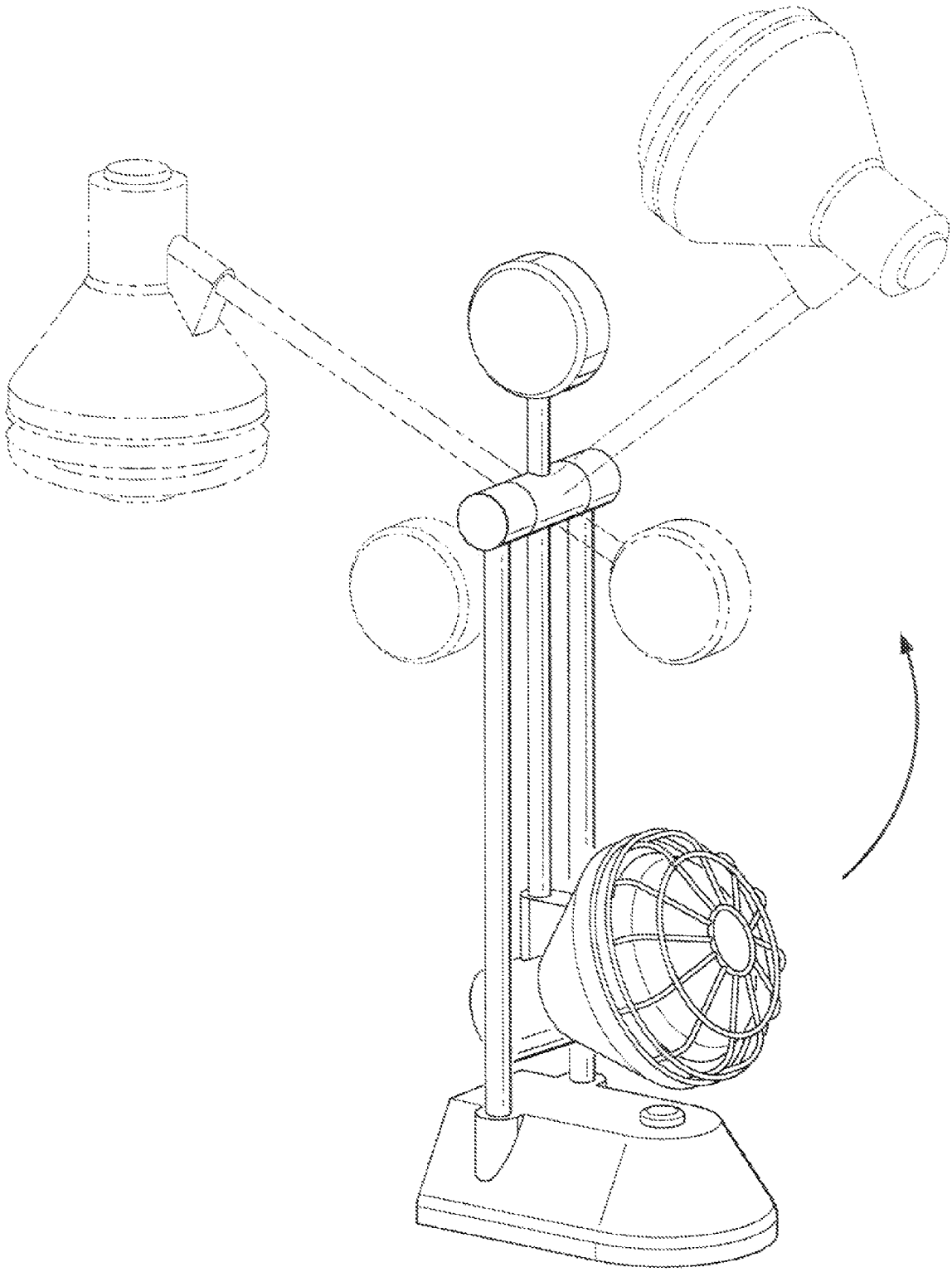
FIGS. 9*a* and 9*b* provide two views of a heat lamp, according to certain embodiments of the present invention.
Figure 9B:
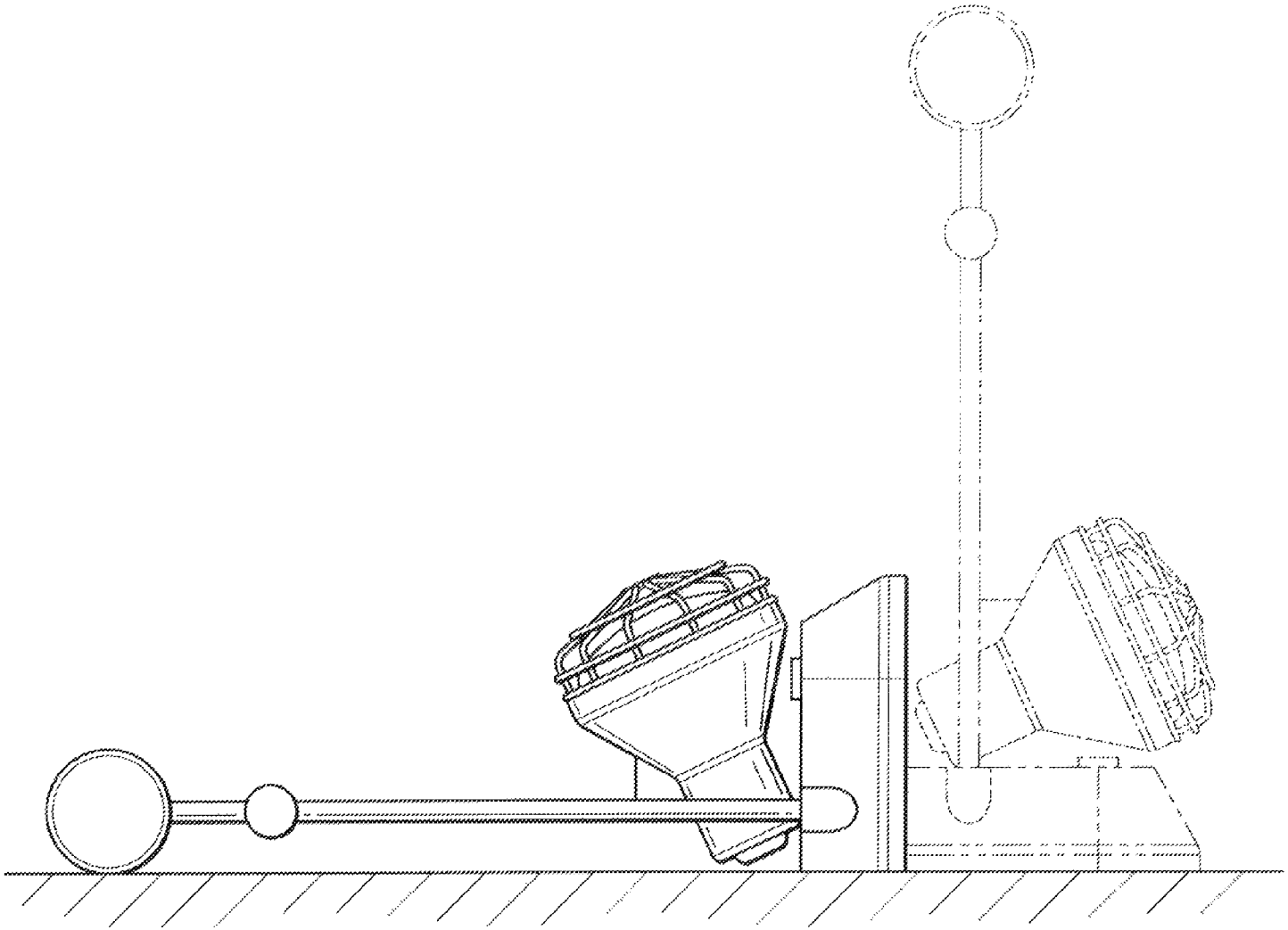

FIGS. 9*a* and 9*b* provide two views of a heat lamp, according to certain embodiments of the present invention. Heat lamp 100 includes lamp 110 may be connected in a fixed relationship with support arm 120, which may be connected in a fixed relationship with base 130. Support arm 120 may include a pivot and a counterbalance. Heat lamp 100 is illustrated in an operating (or open) position and a storage (or closed) position as well as in a transition between the two positions.

FIG. 10 illustrates a cross-sectional view of a heat lamp, arm, and base according to certain embodiments of the present invention. In certain embodiments, fan 620 pulls ambient air into base 130 and forces that air up voids 210 within arms 124. This airflow may be controllably used to assist or resist the convective airflow through head assembly 110.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A heating device of a portable nature comprising:

a head assembly;

a hinge coupled to the head assembly; and an arm coupled to the hinge;

wherein the head assembly comprises:

a heating element;

a reflective shield at least partially surrounding the heating element;

an external shade at least partially surrounding the reflective shield;

a chimney extending at least partially through an upper portion of the external shade, the chimney comprising an external vent and a side port; and an air space between the reflective shield and the external shade, the air space (a) defining a perimeter inlet opening extending around the heating element and (b) communicating with an inside area of the chimney via the side port of the chimney, thereby defining a convective air flow path into the air space via the perimeter inlet opening, through the air space, into the inside area of the chimney via the side port of the chimney, and out of the head assembly via the external vent of the chimney.

2. The heating device of claim 1, wherein the arm rotates.

3. The heating device of claim 1, wherein the hinge comprises a first hinge and a second hinge and wherein the arm comprises a first arm and a second arm, wherein the head assembly is coupled to the first hinge, the first hinge is coupled to the first arm, the first arm is coupled to the second hinge, and the second hinge is coupled to the second arm, whereby a multi-hinged arm is formed.

4. The heating device of claim 1, wherein the head assembly, hinge and arm collapse to a storage position.

5. The heating device of claim 1, wherein the head assembly, hinge and arm are adjustable as to the height and orientation of the heating element relative to a heating target.

6. The heating device of claim 1, further comprising a fan that moves air relative to the heating element.

7. A heating device of a portable nature comprising:

an emitter of electromagnetic energy;

a reflective shield at least partially surrounding the emitter;

an external shade at least partially surrounding the reflective shield;

a chimney comprising a thermally insulating material and extending at least partially through an upper portion of the external shade, the chimney comprising an external vent and a side port; and an air space between the reflective shield and the external shade, the air (a) defining a perimeter inlet opening extending around the heating element and (b) communicating with an inside area of the chimney via the side port of the chimney, whereby convective air is allowed to flow around the heating device, into the air space via the perimeter inlet opening, through the air space, into the inside area of the chimney via the side port of the chimney, and out through the external vent of the chimney.

8. The heating device of claim 7, wherein the thermally insulating material comprises a high-temperature plastic.

9. The heating device of claim 7, wherein substantially all of a first convective air flow flowing between the reflective shield and the infrared emitter is channeled through the chimney under normal operating conditions; and wherein a second convective air flow is redirected through the side port of the chimney under at least one of the following abnormal operating conditions:

where the external grille of chimney is at least partially obstructed, and where the emitter is tilted at an angle.

10. The heating device of claim 9, further comprises a thermal cut-off device external to the chimney; and at least a portion of the second convective air flow redirected through the side port of the chimney is directed across the thermal cut-off device.

11. The heating device of claim 7, wherein the external shade comprises the thermally insulating material.

12. The heating device of claim 7, wherein the emitter is of the group consisting essentially of:

a bulb with a filament, a quartz tube, and a ceramic element.

13. The heating device of claim 7, further comprising a second reflective shield wherein the when the heating device is aimed generally downward, the second reflective shield is positioned to reflect at least some electromagnetic energy generally downward that will otherwise travel upward, wherein the second reflective shield does not significantly impede the convective heated air flow from exiting the device upward through the chimney.

14. The heating device of claim 7, wherein a chimney is mounted in the air vent such that substantially all of the convective air flow through the vent flows through the chimney.

15. The heating device of claim 7, further comprising a fan that moves air relative to the heating element.

16. A heating device of a portable nature comprising:

a base;

a lamp assembly including:

an emitter of electromagnetic energy aimed towards a target, a reflective shield at least partially surrounding the emitter and reflecting at least a portion of the electromagnetic energy towards the target, an external shade made from a first thermally insulating material and at least partially surrounding the reflective shield, and a chimney thermally insulated relative to the reflective shield and coupled to at least one of the emitter, the reflective shield and the external shade, the chimney comprising an external vent and a side port; and wherein an air gap between the reflective shield and the external shade (a) defines a perimeter inlet opening extending around the heating element and (b) communicates with an inside area of the chimney through the side port of the chimney, such that convective air is allowed to flow into the air gap via the perimeter inlet opening, through the air gap, into the inside area of the chimney via the side port of the chimney, and out of the head assembly via the external vent of the chimney; and a support arm mechanically connected to the base and the lamp assembly, wherein the support arm movably supports the lamp assembly.

17. The heating device of claim 16, further comprising: a cut-off device that disconnects power to the emitter when the temperature in the air gap exceeds a threshold temperature.

18. The heating device of claim 16, further comprising a tip-over switch that disconnects power to the emitter when the base is tilted past a threshold angle relative to a horizontal axis.

19. The heating device of claim 16, wherein the support arm is extendable.

20. The heating device of claim 16, wherein the lamp assembly further comprises a second reflective shield positioned to reflect downward electromagnetic energy that is emitted upward toward the chimney.

21. The heating device of claim 16, wherein the support arm includes a first hollow member and a second hollow member, an elbow, and a pair of electrical wires, wherein:

the first hollow member is rotatably coupled to the base and coupled to the elbow;

the second hollow member is rotatably coupled to the moveable lamp assembly and coupled to the elbow;

the pair of electrical wires passes through the first and second hollow members; and the arm is configured to be alternatively locked into at least one of:

an operating position suspending the lamp assembly above a target, and a storage position holding the base in proximity to the lamp.

22. The heating device of claim 16, further comprising a fan that moves air relative to the heating element.

23. A heating device of a portable nature comprising:

a base;

a lamp assembly comprising:

a means for generating infrared radiation, a means for reflecting infrared radiation toward an intended target, a means for externally shading and insulating the lamp;

a chimney configured to channel heated convective air flows through the lamp assembly, the chimney including an external vent and a side port and extending at least partially through an upper portion of the means for externally shading and insulating the lamp;

an air gap between the means for reflecting infrared radiation and the means for externally shading and insulating the lamp, the air gap (a) defining a perimeter inlet opening extending around the means for generating infrared radiation and (b) communicating with an inside area of the chimney via the side port of the chimney, thereby defining a convective air flow path into the air gap via the perimeter inlet opening, through the air gap, into the inside area of the chimney via the side port of the chimney, and out of the head assembly via the external vent of the chimney; and a support arm mechanically connected to the base and the lamp assembly, wherein the support arm moveably supports the lamp.

24. The heating device of claim 23, wherein:

the base comprises a platform configured to hold an intended target to be warmed, and the base further comprises a heating element in addition to the lamp assembly and configured to heat the intended target from below the intended target.

25. The heating device of claim 23, wherein the chimney is made at least in part from a high temperature plastic.

26. The heating device of claim 23, further comprising an internal thermal cut-off means for disconnecting power to the means for generating infrared radiation.

27. The heating device of claim 26, wherein the internal thermal cut-off means is arranged to sense a temperature of the means for externally shading and insulating the lamp.

28. The heating device of claim 23, further comprising a means for moving air relative to the means for generating infrared radiation.

* * * * *